US005579989A

United States Patent [19]

Roy et al.

[11] Patent Number: 5,579,989

[45] Date of Patent: Dec. 3, 1996

[54] MULTI-SIDED FLIP-TOP CONTAINER

[75] Inventors: Michael L. Roy, Sanbornton; Darrell K. Bennett, Concord, both of N.H.

[73] Assignee: Universal Packaging Corporation, Concord, N.H.

[21] Appl. No.: 404,182

[22] Filed: Mar. 13, 1995

[51] Int. Cl.[6] ..... B65D 5/02; B65D 5/54

[52] U.S. Cl. ..... 229/110; 220/416; 229/160; 229/160.1; 229/225

[58] Field of Search ..... 229/109, 110, 229/160.1, 225, 160; 220/416, 418

[56] References Cited

U.S. PATENT DOCUMENTS

| | | | |
|---|---|---|---|
| 1,585,505 | 5/1926 | McIndoe . | |
| 2,123,147 | 7/1938 | Snyder . | |
| 2,577,588 | 12/1951 | Paige | 229/109 |
| 2,672,273 | 3/1954 | Smith | 220/416 |
| 2,772,042 | 11/1956 | Hendrick . | |
| 2,808,977 | 10/1957 | McCormick | 220/416 |
| 2,906,444 | 9/1959 | Weiss et al. | 220/416 |
| 2,965,280 | 12/1960 | Miller . | |
| 2,983,424 | 5/1961 | Glass . | |
| 2,998,910 | 9/1961 | Gillan | 220/416 |
| 3,050,233 | 8/1962 | Burgess | 229/160.1 |
| 3,097,783 | 7/1963 | Burt et al. | 229/160 |
| 3,115,292 | 12/1963 | Repking . | |
| 3,190,533 | 6/1965 | Larson | 220/416 |
| 3,342,398 | 9/1967 | Keith | 220/416 |
| 3,467,298 | 9/1969 | Wysocki . | |
| 3,633,815 | 1/1972 | Rosenburg, Jr. . | |
| 3,738,563 | 6/1973 | Eifrid | 229/23 BT |
| 3,738,564 | 6/1973 | Persson . | |
| 4,182,477 | 1/1980 | Paige | 220/416 |
| 4,251,021 | 2/1981 | Swan . | |
| 4,418,862 | 12/1983 | Vesborg . | |
| 4,641,777 | 2/1987 | Fronduti | 229/110 |
| 4,773,622 | 9/1988 | Herlin | 248/174 |
| 5,323,957 | 6/1994 | Roosa | 229/110 |
| 5,325,989 | 7/1994 | Karalus | 220/416 |

*Primary Examiner*—Gary E. Elkins
*Attorney, Agent, or Firm*—Hamilton, Brook, Smith & Reynolds, P.C.

[57] ABSTRACT

A multi-side container prepared from a single blank of paperboard includes a base panel foldably connected to a row of inner side walls. The base panel is also foldably connected to a row of outer side walls which encircle the inner side walls to form a double wall construction. A lid panel is foldably connected to the outer side walls and is bonded to the outer side walls. A tear line crosses at least some of the outer side walls separating an upper portion of the outer side walls from a lower portion. The tear line is capable of being broken to form a recloseable lid comprising the lid panel and upper portions of the outer side walls.

28 Claims, 5 Drawing Sheets

MULTI-SIDED FLIP-TOP CONTAINER

BACKGROUND

Containers having recloseable lids are commonly used to package goods such as food products. Many such containers are cylindrically shaped. Typically, a recloseable cylindrical container consists of a hollow tube having one closed end and a circular lid which fits over the open end to enclose the contents. The closed tube portion of the container is either molded from a single piece of plastic or constructed from multiple pieces paperboard that are bonded together. A drawback of such containers is the relatively high manufacturing costs due to the materials employed and the number of manufacturing steps required.

SUMMARY OF THE INVENTION

Accordingly, there is a need for a less expensive container having a recloseable lid that is functionally comparable to multi-piece cylindrical containers.

The present invention provides a multi-sided container formed from a single blank of paperboard. The container includes a base panel and a series of inner side walls foldably connected together in a row. One of the inner side walls is foldably connected to a side of the base panel. The container also includes a series of outer side walls which are foldably connected together in a row for encircling the inner side walls to provide a double wall construction. One of the outer side walls is foldably connected to another side of the base panel. A lid panel is foldably connected to one of the outer side walls with the remaining outer side walls being securable to the lid panel. A tear line crosses at least some of the outer side walls separating an upper portion of the at least some of the outer side walls from a lower portion. The tear line is capable of being broken to form a recloseable lid including the lid panel and upper portions of the outer side walls.

In preferred embodiments, the container further includes at least one lower flange member foldably connected to at least one inner side wall for bonding to the base panel. Additionally, at least one upper flange member is foldably connected to at least one outer side wall for bonding to the lid panel. A side flange member is foldably connected to a side edge of one of the outer side walls at one end of the row of outer side walls for bonding to another outer side wall located at the other end of the row of outer side walls in order to bond the row of outer side walls into a ring. A lid flange member is foldably connected to the lid panel for bonding to one of the outer side walls.

The outer side wall that is foldably connected to the lid panel is preferably located at the rear of the container. The inner side walls that are closer to the rear of the container are higher than the inner side walls that are further away. The tear line crosses the at least some of the outer side walls at a height which is lower than corresponding inner side walls and angles downwardly away from the rear of the container. When the tear line is broken, the resulting lid has sides formed from the upper portions of the at least some of the outer side walls which fit over upper portions of the inner side walls when the lid is reclosed.

The present invention provides a multi-sided container with a recloseable lid that is functionally comparable to multi-piece cylindrical containers but which is less expensive. The present invention container is less expensive because it is formed from a single piece of paperboard and is erected automatically by machinery. The multiple sides of the present invention container roughly approximate the shape of a cylindrical container while the double wall construction provides added strength and rigidity to the container.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
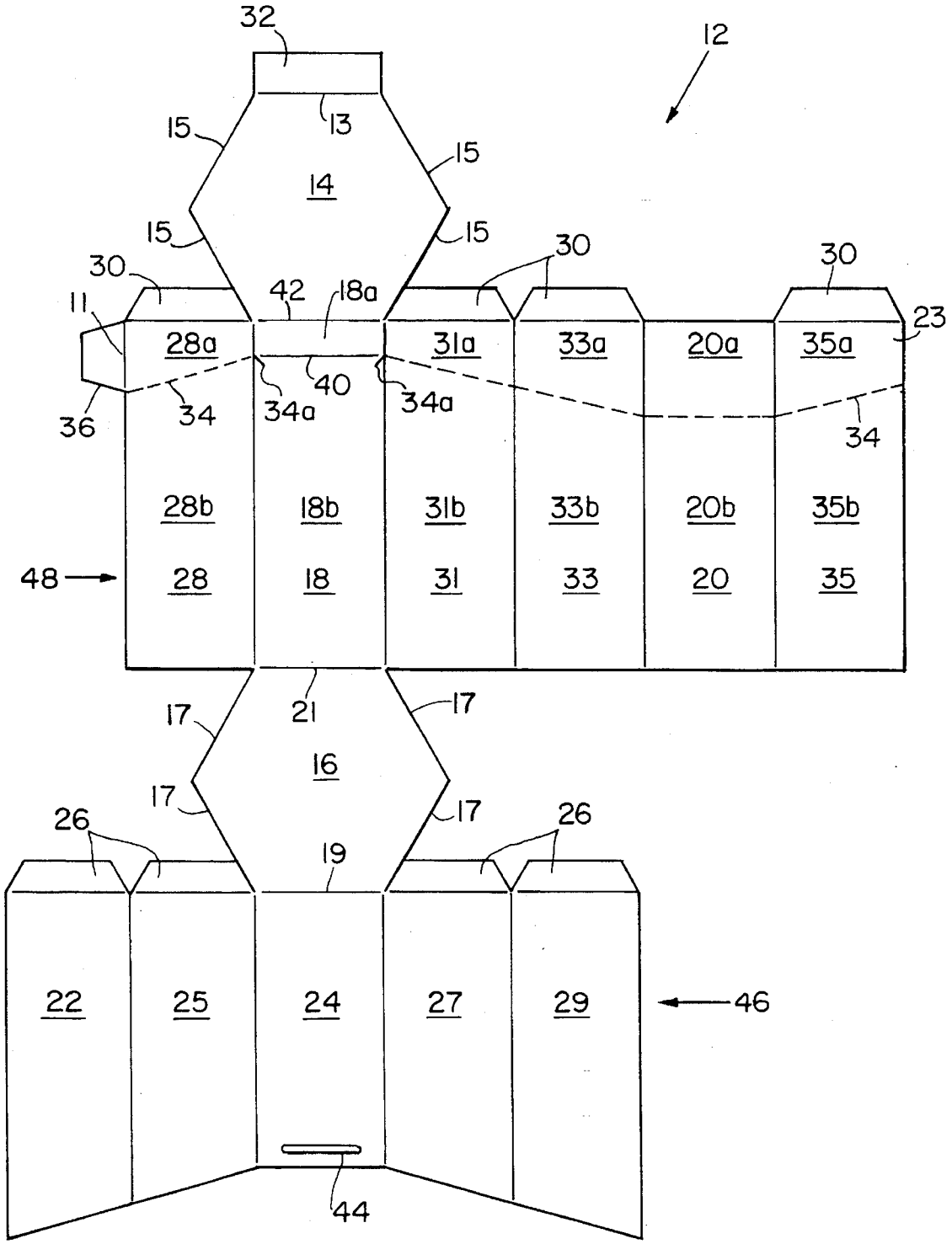
FIG. 1 is a plan view of a blank for constructing the container of the present invention.
Figure 2:
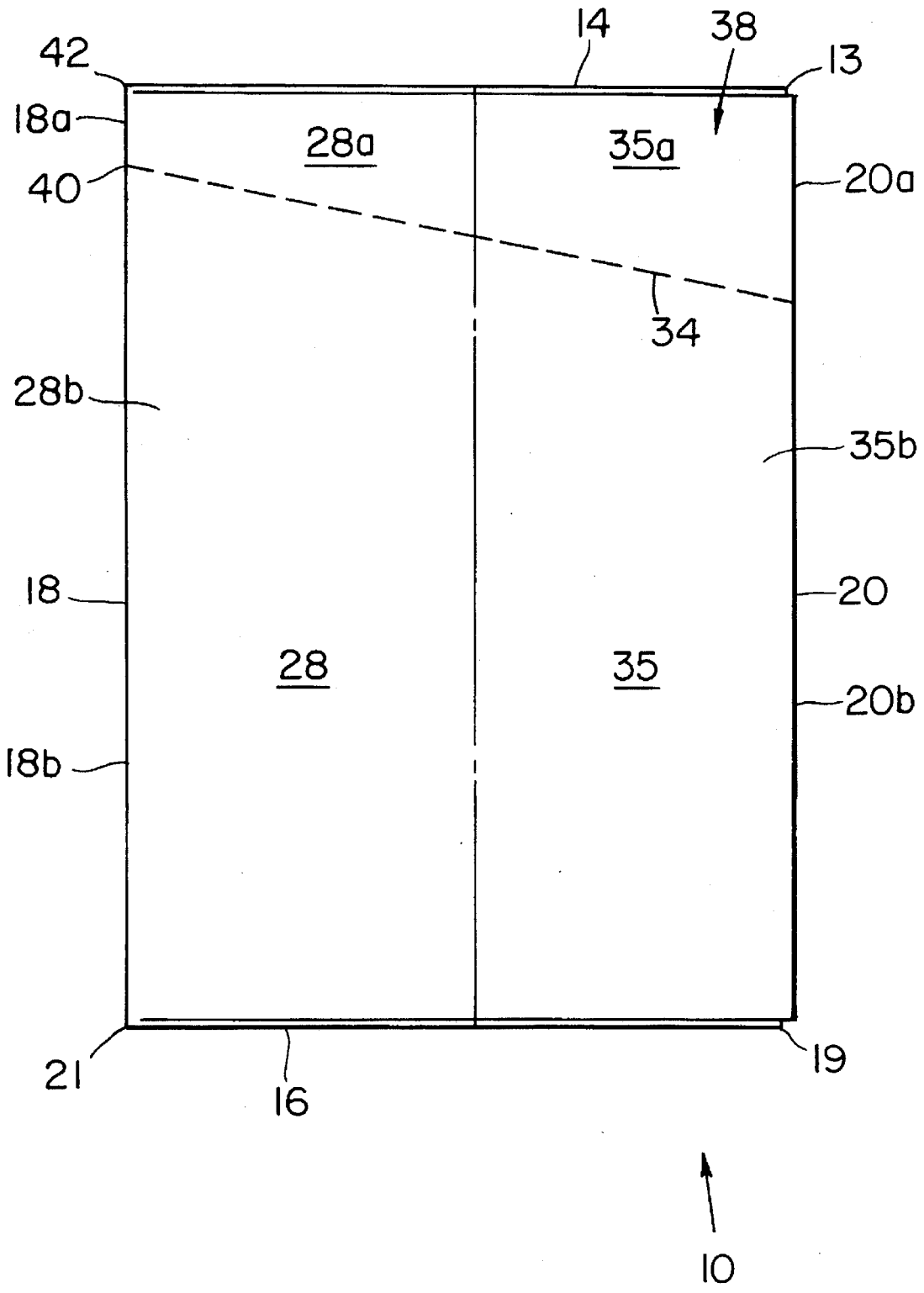
FIG. 2 is a side view of the present invention container made from the blank of FIG. 1.
Figure 3:
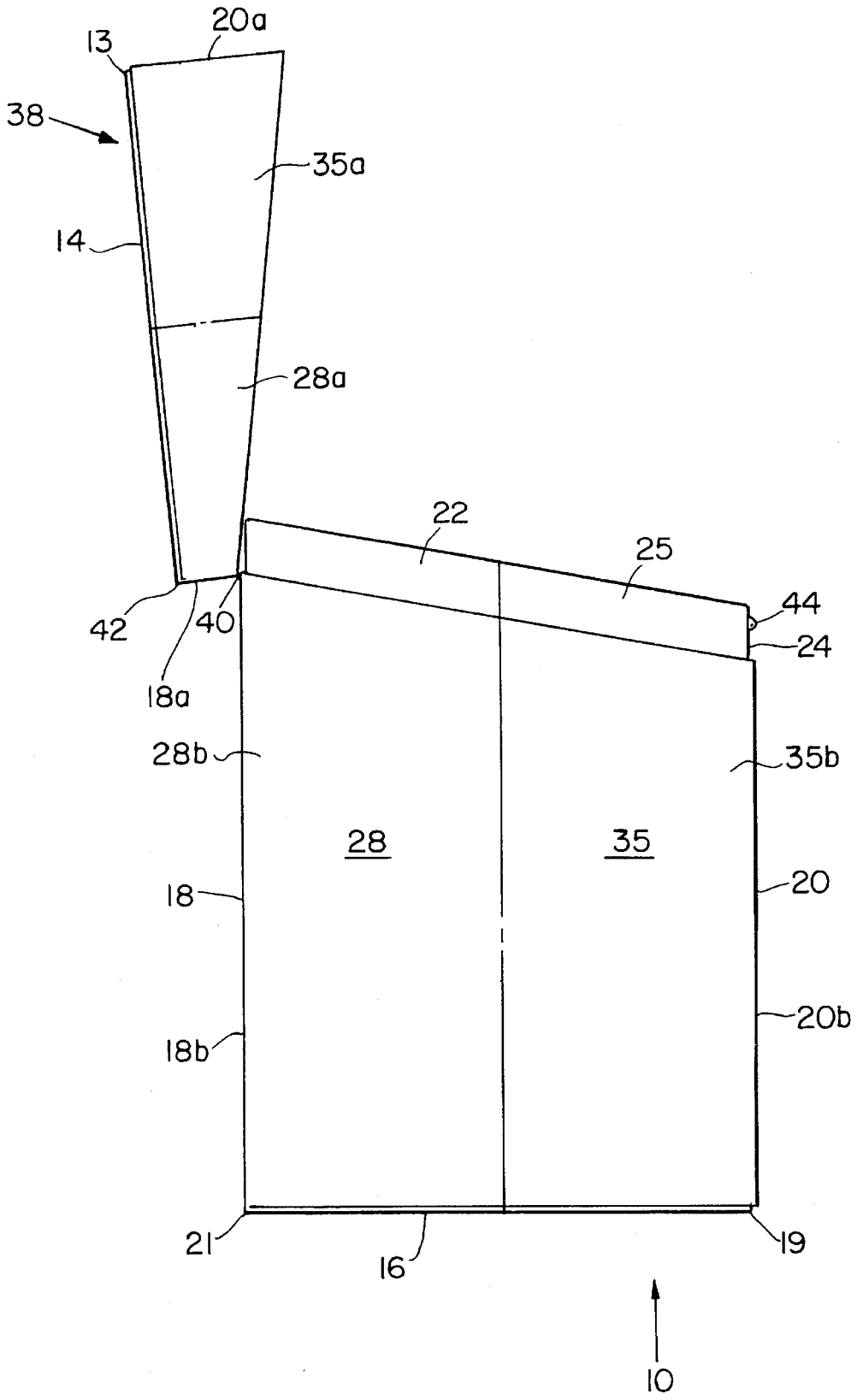
FIG. 3 is a side view of the present invention container with the lid opened.

Referring to FIGS. 1–5, multi-sided container 10 is constructed from a single blank 12 (FIG. 1) of paperboard and includes a hexagonal base panel 16, a hexagonal lid panel 14, six upstanding side walls and a recloseable lid 38. The side walls of container 10 consist of a series of five inner side walls 22, 25, 24, 27 and 29 encircled by a series of six outer side walls 28, 35, 20, 33, 31 and 18 to form double construction walls on five sides. A tear line 34 crosses outer side walls 28, 35, 20, 33 and 31 which when broken, allows container 10 to be opened. To break tear line 34 (FIG. 2), lid 38 is grasped and swung upwardly about fold line 40 on rear wall 18 (FIG. 3).

Figure 5:
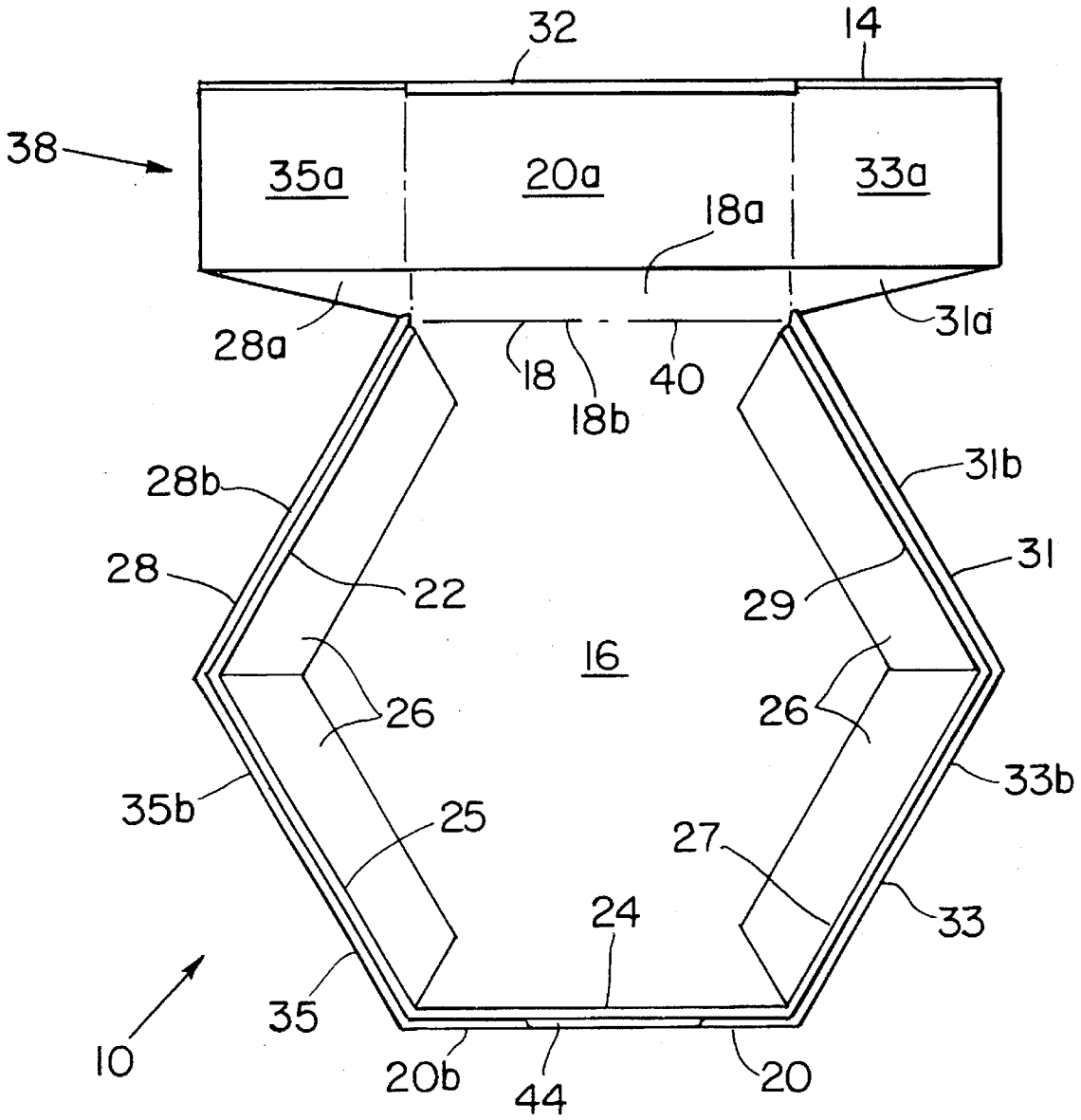
FIG. 5 is a top view of the present invention container with the lid opened.

A more detailed description of container 10 now follows. The inner side walls are foldably connected to each other side-by-side in a row 46 (FIG. 1) and include inner front wall 24, and inner side walls 22, 25, 27 and 29. The base panel 16 is foldably connected to the row 46 of inner side walls by fold line 19 at inner front wall 24. Inner side walls 22 and 25 are positioned on one side of inner front wall 24 and inner side walls 27 and 29 are positioned on the opposite side. Flange members 26 are foldably connected to respective inner side walls 22, 25, 27 and 29 for bonding to base panel 16 along respective sides 17 of base panel 16, thereby securing the inner side walls to base panel 16 (FIG. 5).

The outer side walls are also foldably connected to each other side-by-side in a row 48 (FIG. 1) and include rear wall 18, front outer wall 20 and outer side walls 28, 35, 33 and 31. Base panel 16 is foldably connected to the row 48 of outer side walls by fold line 21 at rear wall 18 on a side of base panel 16 opposite to fold line 19. As a result, as seen in FIG. 1, the row 48 of outer side walls on blank 12 is generally parallel to the row 46 of inner side walls. Outer side wall 28 is positioned on one side of rear wall 18 with outer side walls 31 and 33, outer front wall 20 and outer side wall 35 being positioned on the opposite side. Accordingly, the outer side walls are positioned non-symmetrically about rear wall 18 which makes the row 48 of outer side walls laterally offset with respect to the row 46 of inner side walls.

Figure 4:
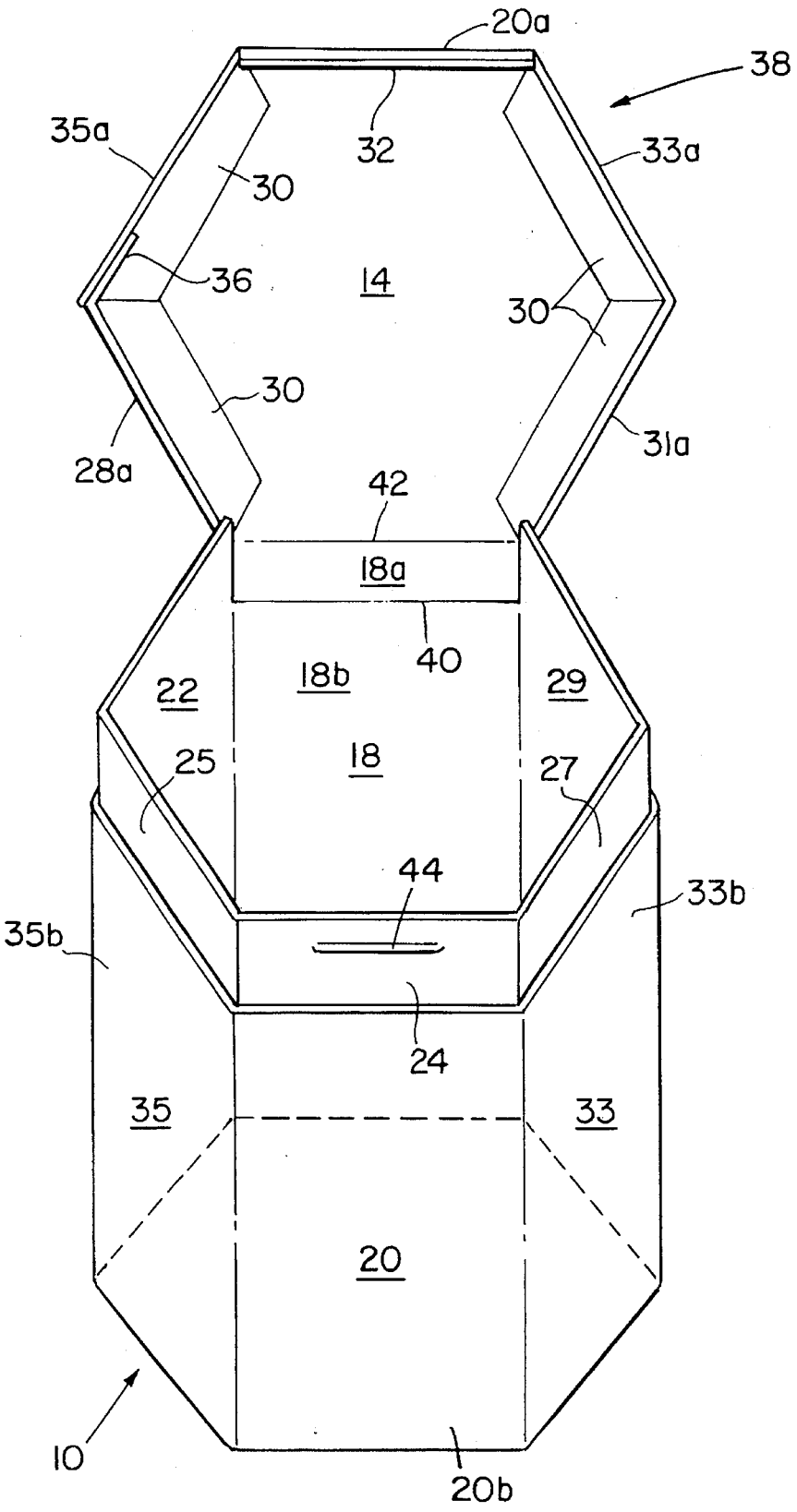
FIG. 4 is a front perspective view of the present invention container with the lid opened.

Flange members 30 are foldably connected to respective upper portions 28*a*, 35*a*, 33*a* and 31*a* of respective outer side walls 28, 35, 33 and 31 for bonding to lid panel 14 along respective sides 15 (FIG. 4). Although the row 46 of inner side walls and the row 48 of outer side walls are depicted in FIG. 1 to be parallel to each other on the blank 12, alternatively, rows 46 and 48 can be foldably connected to base panel 16 in a manner such that rows 46 and 48 are at an angle to each other.

Lid panel 14 is foldably connected to the row 48 of outer side walls by fold line 42 at rear wall 18 (FIG. 1). Lid flange member 32 is foldably connected to lid panel 14 by fold line 13 for bonding to the upper portion 20*a* of outer front wall 20 (FIG. 4). Fold line 13 is located on the side of lid panel 14 opposite to fold line 42. Alternatively, lid flange member 32 could be replaced with an upper flange member foldably connected to outer front wall 20.

Inner front wall 24, base panel 16, rear wall 18, lid panel 14 and lid flange member 32 are preferably foldably connected in line with each other by fold lines 19, 21, 42 and 13 (FIG. 1). Such an orientation makes it easier to erect container 10 automatically with machinery. However, alternatively, base panel 16 and lid panel 14 can be foldably connected to different outer side walls such that base panel 16 and lid panel 14 are laterally offset from each other.

A side flange member 36 is foldably connected to the side edge of the upper portion 28*a* of outer side wall 28 by fold line 11. Side flange member 36 bonds to edge 23 on the upper portion 35*a* of outer side wall 35 to bond outer side walls 28, 18, 31, 33, 20 and 35 and their respective upper portions 28*a*, 18*a*, 31*a*, 33*a*, 20*a* and 35*a* into a ring. Although side flange member 36 is shown to be a small tab, alternatively, side flange 36 can be made larger and could be a seventh outer side wall.

Tear line 34 crosses outer side walls 28, 31 and 33, outer front wall 20 and outer side wall 35 for weakening and separating upper portions 28*a*, 31*a*, 33*a*, 20*a* and 35*a* from respective lower portions 28*b*, 31*b*, 33*b*, 20*b* and 35*b* (FIG. 1). When container 10 is assembled, tear line 34 angles downwardly from rear wall 18 to outer front wall 20 (FIG. 2). Breaking tear line 34 when container 10 is assembled separates the upper portions 28*a*, 35*a*, 20*a*, 33*a* and 31*a* of outer side walls 28, 35, 20, 33 and 31 from the respective lower portions 28*b*, 35*b*, 20*b*, 33*b* and 31*b* (FIGS. 3–5). Tear line 34 terminates at rear wall 18 at two small downwardly angled cut portions 34*a*. Tear line 34 in the preferred embodiment is a perforated or knife cut line and can be configured to provide a pull tab. Alternatively, tear line 34 can be cut by a laser, charred by heat or formed by chemical treatment. Additionally, tear line 34 can completely encircle the container 10 such that when tear line 34 is broken, the lid 38 is completely removable. Furthermore, tear line 34 does not have to angle downwardly but instead can be horizontal.

Breaking tear line 34 causes the formation of recloseable lid 38. Lid 38 consists of lid panel 14 and the upper portions 18*a*, 28*a*, 35*a*, 20*a*, 33*a* and 31*a* of the outer side walls 18, 28, 35, 20, 33 and 31. Lid 38 is foldably connected to rear wall 18 by fold line 40. Fold line 40 crosses rear wall 18 between angled portions 34*a* separating upper portion 18*a* of rear outer wall 18 from lower portion 18*b* and allows lid 38 to be pivotally opened and closed. To reclose lid 38, lid 38 is swung downwardly about fold line 40 such that the upper portions 28*a*, 35*a*, 20*a*, 33*a* and 31*a* of the outer side walls fit over the upper portions of respective inner side walls 22, 25, 24, 27 and 29.

When container 10 is opened (FIGS. 3 and 4), the lower portions of the outer side walls that are closer to rear wall 18 are higher than the lower portions of the outer side walls that are further away from rear wall 18. Additionally, the inner side walls that are closer to rear wall 18 are higher than the inner side walls that are further away from rear wall 18. The height of inner side walls 22, 25, 24, 27 and 29 are higher than the adjacent corresponding lower portions 28*b*, 35*b*, 20*b*, 33*b* and 31*b* of outer side walls 28, 35, 20, 33 and 31. As a result, the inner side walls extend above lower portions 28*b*, 35*b*, 20*b*, 33*b* and 31*b*. An embossed portion 44 can optionally be included on the upper part of inner front wall 24. The embossed portion 44 provides a protrusion which presses against upper portion 20*a* of outer front wall 20 to keep lid 38 in place when reclosed. Although the height of the inner side walls closer to rear wall 18 is preferably higher than the height of those which are further away, alternatively, the height of all the inner side walls can be constant.

Container 10 is assembled from blank 12 preferably by automated machinery in the manner described below. The row 46 of inner side walls 22, 25, 24, 27 and 29 are folded upwardly from base panel 16 along fold line 19. In addition, inner side walls 22, 25, 24, 27 and 29 are also folded inwardly towards each other. Lower flange members 26 are folded perpendicular to their respective inner side walls and are bonded to base panel 16 along respective sides 17 of base panel 16.

The row 48 of outer side walls 28, 18, 31, 33, 20 and 35 is folded upwardly from base panel 16 along fold line 21. The outer side walls 28, 18, 31, 33, 20 and 35 are also folded inwardly towards each other, thereby encircling the inner side walls such that outer side walls 28, 35, 20, 33 and 31 are adjacent to respective inner side walls 22, 25, 24, 27 and 29 in that order. Outer side walls 28, 35, 20, 33 and 31 can optionally be bonded to respective inner side walls 22, 25, 24, 27 and 29. Side flange member 36 is bonded to edge 23 of the upper portion 35*a* of outer side wall 35 to bond the outer side walls 28, 18, 31, 33, 20 and 35 into a ring.

Lid panel 14 is downwardly folded from rear wall 18 along fold line 42. Upper flange members 30 are folded perpendicular to their respective outer side walls 28, 31, 33 and 35 and are bonded to lid panel 14 along respective sides 15 of lid panel 14. Lid flange member 32 is folded perpendicular to lid panel 14 and is bonded to the upper portion 20*a* of outer front wall 20.

Container 10 is preferably bonded together with an adhesive. However, alternatively, the blank 12 can be coated with a plastic coating to allow heat sealing. Additionally, although the assembly of container 10 has been described in a particular order, the order of the steps can be varied. Furthermore, container 10 can also be assembled by hand.

EQUIVALENTS

While this invention has been particularly shown and described with references to preferred embodiments thereof, it will be understood by those skilled in the art that various changes in form and details may be made therein without departing from the spirit and scope of the invention as defined by the appended claims.

For example, in the preferred embodiment, container 10 has six sides with six outer side walls and five inner side walls. Alternatively, the number of inner side walls can be more than five or less than five. Additionally, the number of outer side walls can be more than six or less than six. Furthermore, container 10 can have more than six sides or less than six sides. Also, although, the inner and outer side walls have been shown to be secured to base panel 16 and lid panel 14 with flange members foldably connected to the inner and outer side walls, alternatively, such flange members can instead be foldably connected to the base panel and the lid panel. Tear line 34 can also be pre-broken on blank 12 so that when container 10 is assembled, lid 38 can be opened without breaking tear line 34.

What is claimed is:

1. A multi-sided container comprising:

a single hexagonal base panel;

a series of inner side walls foldably connected together in a row, one of the inner side walls being foldably connected to a side of the base panel;

a series of outer side walls foldably connected together in a row encircling the inner side walls, one of the outer side walls being foldably connected to another side of the base panel;

a single hexagonal lid panel foldably connected to one of the outer side walls, at least some of the outer side walls being secured to the lid panel, each to a respective side of the lid panel; and a tear line crossing at least some of the outer side walls separating an upper portion of the at least some of the outer side walls from a lower portion, the tear line capable of being broken to form a lid comprising the lid panel and said upper portions of the outer side walls.

2. The container of claim 1 further comprising at least one lower flange member foldably connected to at least one of said inner side walls and bonded to the base panel.

3. The container of claim 1 further comprising at least one upper flange member foldably connected to at least one of said outer side walls and bonded to the lid panel.

4. The container of claim 1 in which the row of outer side walls has a first end and a second end, the container further comprising a side flange member foldably connected to a side edge of the first end and bonded to the second end, thereby bonding the row of outer side walls into a ring.

5. The container of claim 1 further comprising a lid flange member foldably connected to the lid panel and bonded to one of the outer side walls.

6. The container of claim 1 in which the container has a rear wherein the outer side wall that is foldably connected to the lid panel is at the rear of the container, the inner side walls which are closer to the rear of the container are higher than the inner side walls that are further away.

7. The container of claim 6 in which the tear line crosses the at least some of the outer side walls at a height which is lower than the inner side walls which are encircled by said at least some of the outer side walls.

8. The container of claim 7 in which the tear line angles downwardly away from the rear of the container.

9. The container of claim 1 in which the lid is recloseable.

10. The container of claim 9 in which the lid has sides formed from said upper portions of the outer side walls which fit over upper portions of the inner side walls when the lid is reclosed.

11. A multi-sided container comprising:

a single hexagonal base panel;

a series of inner side walls foldably connected together in a row, one of the inner side walls being foldably connected to a side of the base panel;

a series of outer side walls foldably connected together in a row encircling the inner side walls, one of the outer side walls being foldably connected to another side of the base panel;

a single hexagonal lid panel foldably connected to one of the outer side walls;

at least one lower flange member foldably connected to at least one of said inner side walls and bonded to the base panel;

at least one upper flange member foldably connected to at least one of said outer side walls and bonded to the lid panel; and a tear line crossing at least some of the outer side walls separating an upper portion of the at least some of the outer side walls from a lower portion, the tear line capable of being broken to form a lid comprising the lid panel and said upper portions of the outer side walls.

12. The container of claim 11 in which the row of outer side walls has a first end and a second end, the container further comprising a side flange member foldably connected to a side edge of the first end and bonded to the second end, thereby bonding the row of outer side walls into a ring.

13. The container of claim 11 further comprising a lid flange member foldably connected to the lid panel and bonded to one of the outer side walls.

14. The container of claim 11 in which the container has a rear wherein the outer side wall that is foldably connected to the lid panel is at the rear of the container, the inner side walls which are closer to the rear of the container are higher than the inner side walls that are further away.

15. The container of claim 14 in which the tear line crosses the at least some of the outer side walls at a height which is lower than the inner side walls which are encircled by said at least some of the outer side walls.

16. The container of claim 15 in which the tear line angles downwardly away from the rear of the container.

17. The container of claim 11 in which the lid is recloseable.

18. The container of claim 17 in which the lid has sides formed from said upper portions of the outer side walls which fit over upper portions of the inner side walls when the lid is reclosed.

19. A blank for forming a multi-sided container comprising:

a single hexagonal base panel;

a series of inner side walls foldably connected together in a row, one of the inner side walls being foldably connected to a side of the base panel;

a series of outer side walls foldably connected together in a row for encircling the inner side walls, one of the outer side walls being foldably connected to another side of the base panel;

a single hexagonal lid panel foldably connected to one of the outer side walls, at least some of the outer side walls capable of being secured to the lid panel, each to a respective side of the lid panel; and a tear line crossing at least some of the outer side walls separating an upper portion of the at least some of the outer side walls from a lower portion, the tear line capable of being broken when the container is assembled to form a lid comprising the lid panel and said upper portions of the outer side walls.

20. A multi-sided container comprising:

a base panel;

a series of inner side walls foldably connected together in a row, one of the inner side walls being foldably connected to a side of the base panel;

a series of outer side walls foldably connected together in a row encircling the inner side walls, one of the outer side walls being foldably connected to another side of the base panel;

a lid panel foldably connected to one of the outer side walls, at least some of the outer side walls being secured to the lid panel, each to a respective side of the lid panel;

a lid flange member foldably connected to the lid panel and bonded to one of the outer side walls; and a tear line crossing at least some of the outer side walls separating an upper portion of the at least some of the outer side walls from a lower portion, the tear line capable of being broken to form a lid comprising the lid panel and said upper portions of the outer side walls.

21. A multi-sided container comprising:

a base panel;

a series of inner side walls foldably connected together in a row, one of the inner side walls being foldably connected to a side of the base panel;

a series of outer side walls foldably connected together in a row encircling the inner side walls, one of the outer side walls being foldably connected to another side of the base panel;

a lid panel foldably connected to one of the outer side walls, at least some of the outer side walls being secured to the lid panel, each to a respective side of the lid panel, the container having a rear wherein the outer side wall that is foldably connected to the lid panel is at the rear of the container, the inner side walls which are closer to the rear of the container are higher than the inner side walls that are further away; and a tear line crossing at least some of the outer side walls separating an upper portion of the at least some of the outer side walls from a lower portion, the tear line capable of being broken to form a lid comprising the lid panel and said upper portions of the outer side walls.

22. The container of claim 21 in which the tear line crosses the at least some of the outer side walls at a height which is lower than the inner side walls which are encircled by said at least some of the outer side walls.

23. The container of claim 22 in which the tear line angles downwardly away from the rear of the container.

24. A multi-sided container comprising:

a base panel;

a series of inner side walls foldably connected together in a row, one of the inner side walls being foldably connected to a side of the base panel;

a series of outer side walls foldably connected together in a row encircling the inner side walls, one of the outer side walls being foldably connected to another side of the base panel;

a lid panel foldably connected to one of the outer side walls;

at least one lower flange member foldably connected to at least one of said inner side walls and bonded to the base panel;

at least one upper flange member foldably connected to at least one of said outer side walls and bonded to the lid panel;

a lid flange member foldably connected to the lid panel and bonded to one of the outer side walls; and a tear line crossing at least some of the outer side walls separating an upper portion of the at least some of the outer side walls from a lower portion, the tear line capable of being broken to form a lid comprising the lid panel and said upper portions of the outer side walls.

25. A multi-sided container comprising:

a base panel;

a series of inner side walls foldably connected together in a row, one of the inner side walls being foldably connected to a side of the base panel;

a series of outer side walls foldably connected together in a row encircling the inner side walls, one of the outer side walls being foldably connected to another side of the base panel;

a lid panel foldably connected to one of the outer side walls, the container having a rear wherein the outer side wall that is foldably connected to the lid panel is at the rear of the container, the inner side walls which are closer to the rear of the container are higher than the inner side walls that are further away;

at least one lower flange member foldably connected to at least one of said inner side walls and bonded to the base panel;

at least one upper flange member foldably connected to at least one of said outer side walls and bonded to the lid panel; and a tear line crossing at least some of the outer side walls separating an upper portion of the at least some of the outer side walls from a lower portion, the tear line capable of being broken to form a lid comprising the lid panel and said upper portions of the outer side walls.

26. The container of claim 25 in which the tear line crosses the at least some of the outer side walls at a height which is lower than the inner side walls which are encircled by said at least some of the outer side walls.

27. The container of claim 26 in which the tear line angles downwardly away from the rear of the container.

28. A multi-sided container comprising:

a hexagonal base panel;

a series of at least four inner side walls foldably connected together in a row, one of the inner side walls being foldably connected to a side of the base panel;

a series of at least five outer side walls foldably connected together in a row encircling the inner side walls, one of the outer side walls being foldably connected to another side of the base panel;

a hexagonal lid panel foldably connected to one of the outer side walls, at least some of the outer side walls being secured to the lid panel, each to a respective side of the lid panel; and a tear line crossing at least some of the outer side walls separating an upper portion of the at least some of the outer side walls from a lower portion, the tear line capable of being broken to form a lid comprising the lid panel and said upper portions of the outer side walls.

* * * * *